US010823516B2

(12) United States Patent
Walsh

(10) Patent No.: US 10,823,516 B2
(45) Date of Patent: Nov. 3, 2020

(54) GROUND-DETECTING DESCALER

(71) Applicant: Joseph F. Walsh, Sequim, WA (US)

(72) Inventor: Joseph F. Walsh, Sequim, WA (US)

( * ) Notice: Subject to any disclaimer, the term of this patent is extended or adjusted under 35 U.S.C. 154(b) by 0 days.

(21) Appl. No.: 15/456,514

(22) Filed: Mar. 11, 2017

(65) Prior Publication Data

US 2017/0261540 A1 Sep. 14, 2017

Related U.S. Application Data

(60) Provisional application No. 62/308,028, filed on Mar. 14, 2016.

(51) Int. Cl.
*F28G 13/00* (2006.01)
*G01R 31/02* (2006.01)

(52) U.S. Cl.
CPC ..... *F28G 13/00* (2013.01)

(58) Field of Classification Search
CPC ..... G01R 31/025; F28G 13/00
See application file for complete search history.

(56) References Cited

U.S. PATENT DOCUMENTS 4,082,666 A * 4/1978 Jones ..... B01J 47/14 137/93
5,065,104 A * 11/1991 Kusko ..... G01R 31/025 324/122
5,469,063 A * 11/1995 Winter ..... G01R 19/155 324/508
5,945,802 A * 8/1999 Konrad ..... F04D 15/0066 318/490
6,021,033 A * 2/2000 Benham ..... F21S 8/00 361/1
6,625,824 B1 * 9/2003 Lutz ..... E04H 4/12 137/625.21
2005/0161379 A1 * 7/2005 Tsuboi ..... C02F 1/485 210/138
2015/0239757 A1 * 8/2015 Hughes ..... C02F 1/487 204/557
2017/0373630 A1 * 12/2017 Figie ..... H02P 29/024

* cited by examiner

*Primary Examiner* — Akm Zakaria
(74) *Attorney, Agent, or Firm* — Olympic Patent Works PLLC

(57) ABSTRACT

The current document discloses a ground-detecting direct-wire descaler that detects and indicates whether or not a descaling signal with sufficient current and voltage is produced or, in other words, detects and indicates whether the pipe or other equipment to which the ground-detecting direct-wire descaler is coupled is isolated from AC ground. AC-ground detection occurs both on initial power on and at regular monitoring intervals. In certain implementations, ground-detecting direct-wire descaler additionally detects and indicates whether or not the three-pronged outlet, into which the power-cord plug of the ground-detecting direct-wire descaler is inserted, conforms to UBC standards and therefore has safety ground available for use as signal ground. The ground-detecting direct-wire descaler only attempts to produce a descaling signal when safety ground is detected.

4 Claims, 8 Drawing Sheets

GROUND-DETECTING DESCALER

CROSS-REFERENCE TO RELATED APPLICATION

This application claims the benefit of Provisional Application No. 62/308,028, filed Mar. 14, 2016.

TECHNICAL FIELD

The current document is directed to electronic descaler units that propagate alternating currents through water in order to remove scale deposits from the surfaces of heating elements and the interiors of water heaters, pipes, and other water-containing equipment and, in particular, to an electronic descaler unit that automatically detects problems that inhibit descaler effectiveness and displays problem-identifying indications.

BACKGROUND

Scale deposits are generally composed of calcium and magnesium salts, including calcium carbonate, magnesium hydroxide, magnesium carbonate, and calcium sulfate. Precipitation of these salts is caused by thermal decomposition of bicarbonate ions as well as saturation concentrations of the dissolved salts in water resulting from temperature and pH changes. Precipitates of these salts produce scale that accumulates on the inner walls of plumbing pipes, heating elements in hot water heaters, and dishwashers. Water boilers, often used for heating buildings, have even greater scale problems because of elevated temperatures at which they operate. Any device that heats water or transports water has a potential for scaling problems. The scale builds up over time and clogs pipes, restricting water flow, and coats heating elements, rendering them far less efficient at converting energy into hot water. This, in turn, lowers the performance of appliances heat water and/or receive water from pipes and increases costs associated with heating water and storing hot water.

Descalers are electronic devices that transmit a time-varying electrical signal, referred to as a "descaling signal," through the water in pipes, water heaters, and other water-containing equipment. Descaling signals alter the electrochemical environment surrounding scale deposits, redissolving the calcium and magnesium salts of scale deposits and releasing the scale deposits from the inner surfaces of water pipes and on heating elements. The descaling signal also inhibits redeposition of scale build-up.

The descaling signal is introduced into water within a water pipe by either magnetic coupling or hard wiring. The majority of currently available descalers use magnetic coupling. Magnetic coupling is accomplished by either wrapping a wire coil around a pipe or by clamping a ferromagnetic ring round the pipe. Installing a wire coil on a pipe is time consuming and often difficult when the pipe is mounted on a wall or other surface. Installing a ferromagnetic ring is less time consuming, but ferro-magnetic-ring couplings tends to be fragile. In either case, magnetic coupling is an inefficient means of introducing a descaling signal into the water within a pipe. In comparison tests, it is common for a descaling signal introduced into water within a pipe by a direct-wire descaler to have fifty or more times greater amplitude than descaling signals introduced into water within the same pipe by magnetically coupled devices.

Hard wiring involves installing wiring directly to a short section of metal water pipe that is isolated from AC ground.

An alternating voltage signal, using AC power ground for signal ground, is input to the metal water pipe through the wiring. Hard wiring inputs an electrical current into the water within a pipe far more efficiently than magnetic coupling. The short section of metal pipe is isolated from the AC ground of hot water heaters and other grounds connected to water pipes. In buildings constructed to latest building codes, water pipes are isolated from ground, allowing a descaler to be connected almost anywhere on the plumbing system. Many houses have water heaters with corrugated copper supply pipes that provide an excellent place to connect a direct-wire descaler.

AC grounded metal pipes present problems to both magnetically coupled and direct-wire electronic descalers. When a descaling signal traveling through water encounters an AC grounded metal pipe, the descaling signal shorts to AC ground and is no longer able promote descaling. The two most common causes of AC grounded metal pipes are: (1) using a metal water main for AC ground for the power system of building; and (2) not insolating metal pipes in contact with hot water heaters that are almost always connected to AC ground. Unfortunately, when descalers are installed, plumbing is generally not checked for AC grounding. Even when they are checked, events after installation can result in AC grounding of a plumbing system In many cases, currently available descalers appear to operate correctly but fail to produce sufficient descaling signals to descale the equipment to which they are coupled.

Direct-wire descaler devices may fail to effectively operate for another reason. Magnetically coupled devices may be plugged into either two-prong or three-prong outlets. Direct-wire descaler devices, by contrast, use the safety ground, referred to as the "green wire," as signal ground for the descaler signal. When the three-prong outlet does not provide safety ground, as required by Uniform Building Code ("UBC"), the descaling device is not able to propagate a descaling signal into water within pipes and other equipment.

Descaling devices that work in one installation fail to work in others. "Power on" LEDs which appear to indicate that a descaling device is functioning, in fact only indicate that power is on, but do not indicate whether the power is being conducted to AC ground or whether, instead, the power is generating an effective descaling signal. As a consequence, there is widespread dissatisfaction in the descaling-device industry.

SUMMARY

The current document discloses a ground-detecting direct-wire descaler that detects and indicates whether or not a descaling signal with sufficient current and voltage is produced or, in other words, detects and indicates whether the pipe or other equipment to which the ground-detecting direct-wire descaler is coupled is isolated from AC ground. AC-ground detection occurs both on initial power on and at regular monitoring intervals. In certain implementations, ground-detecting direct-wire descaler additionally detects and indicates whether or not the three-pronged outlet, into which the power-cord plug of the ground-detecting direct-wire descaler is inserted, conforms to UBC standards and therefore has safety ground available for use as signal ground. The ground-detecting direct-wire descaler only attempts to produce a descaling signal when safety ground is detected.

DETAILED DESCRIPTION

As discussed above, there are several problems associated with installation and operation of currently available direct-wire descalers. A direct-wire descaler needs to be coupled to a pipe or other equipment that is isolated from AC ground and a direct-wire descaler uses the safety ground provided by correctly wired three-prong outlets. When a direct-wire descaler is coupled to pipes or other equipment that is not isolated from AC ground and/or when a direct-wire descaler cannot access safety ground, the direct-wire descaler fails to produce an effective descaling signal. Currently available direct-wire descaler devices do not detect, indicate, or otherwise address these two problems, as a result of which they often fail to produce an adequate descaling signal. The currently disclosed ground-detecting direct-wire descaling device addresses both problems by detecting and indicating whether or not the three-pronged outlet, into which the power-cord plug of the ground-detecting direct-wire descaler is inserted, conforms to UBC standards and therefore has safety ground available for use as signal ground and by detecting and indicating whether or not the pipe or other equipment to which the ground-detecting direct-wire descaler is coupled is isolated from AC ground. Ground-detection occurs both on initial power on and at regular monitoring intervals. The AC grounding problem can be avoided or minimized by installing a descaler as far away from AC ground as possible. The currently disclosed ground-detecting direct-wire descaling device continuously outputs an indication of the strength of the output descaling signal as well as indicating whether or not the output descaling signal has a current or voltage less than a threshold current and voltage, with greater-than-threshold values indicating a short to AC ground. The currently disclosed ground-detecting direct-wire descaling device thus assists an installer in determining a direction in which a descaler can be moved along a pipe ameliorate lack of AC-ground isolation in addition to indicating whether or not an adequate descaling signal is being introduced into the water within a pipe or other equipment. This gives an installer of the currently disclosed ground-detecting direct-wire descaling device an opportunity to detect and correct AC ground problems and/or to find a connection point with an optimum decaling signal. AC-ground detection may also be added as a new feature to magnetically coupled descalers, according to the current document.

Figure 1:
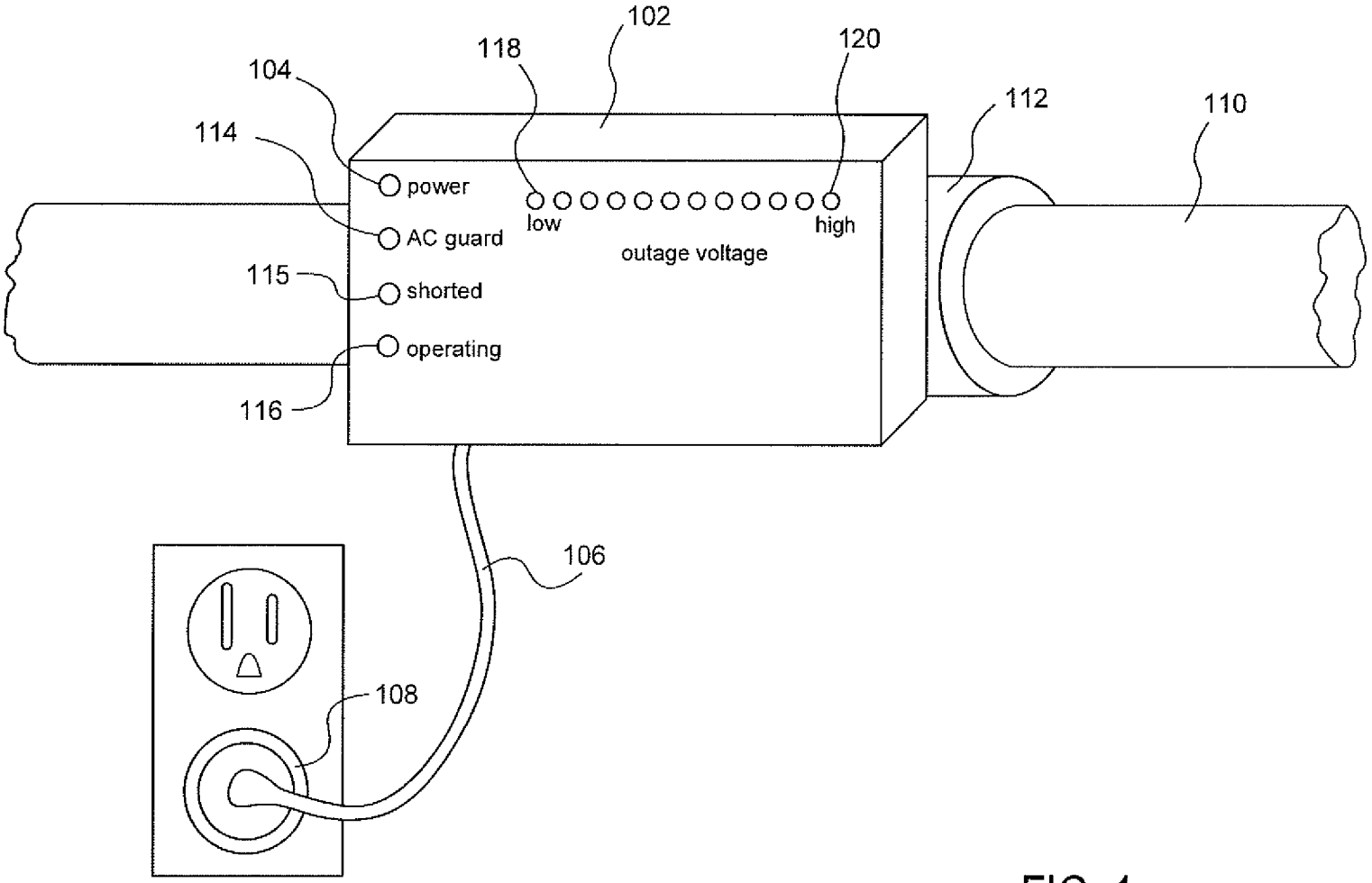
FIG. 1 shows a generalized ground-detecting, direct-wire descaler that represents one implementation of the ground-detecting, direct-wire descaler to which the current document is directed.

FIG. 1 shows a generalized ground-detecting, direct-wire descaler that represents one implementation of the ground-detecting, direct-wire descaler to which the current document is directed. The ground-detecting descaler 102 includes an electronics and display case on which indicator lights, such as indicator light 104, are positioned and within which electronic components of the descaler are contained. The electronic components are discussed, below, with reference to FIGS. 2-4D. A power cord 106 is shown descending from the ground-detecting, direct-wire descaler to a three-prong outlet 108. The descaler is mounted to a water pipe 110 by a mechanical coupler 112 that additionally provides a direct coupling of a conductor on which the descaling signal is output by the direct-wire, ground-detecting descaler to the water pipe.

The ground-detecting, direct-wire descaler includes four status-indicator lights 104 and 114-116. In addition, the ground-detecting, direct-wire descaler includes a series of descaler-signal-strength-indicating lights, starting with a low-voltage light 118 and ending with a high-voltage light 120. The power light 104 is illuminated when the descaler is powered on. The AC-ground light 114 is illuminated when safety ground is detected by the descaler. The shorted light 115 is illuminated when the descaler determines that the voltage of the output descaling signal is sufficiently low to indicate that the water pipe 110 is not isolated from AC ground. The operating light 116 is illuminated when the descaler is properly functioning and outputting an effective descaling signal. The descaler-signal-strength-indicating lights are illuminated from the low-voltage light 118 rightward to indicate the voltage level of the output descaling signal. When a very high-voltage output signal is being generated, all of the descaler-signal-strength-indicating-lights are illuminated while, for descaling signals of less voltage, only a portion of the descaler-signal-strength-indicating lights are illuminated from the low-voltage light 118 rightward along the series of descaler-signal-strength-indicating lights. When the descaler fails to detect safety ground, only the power light 104 remains illuminated and the descaler does not attempt to output a descaling signal.

Figure 2:
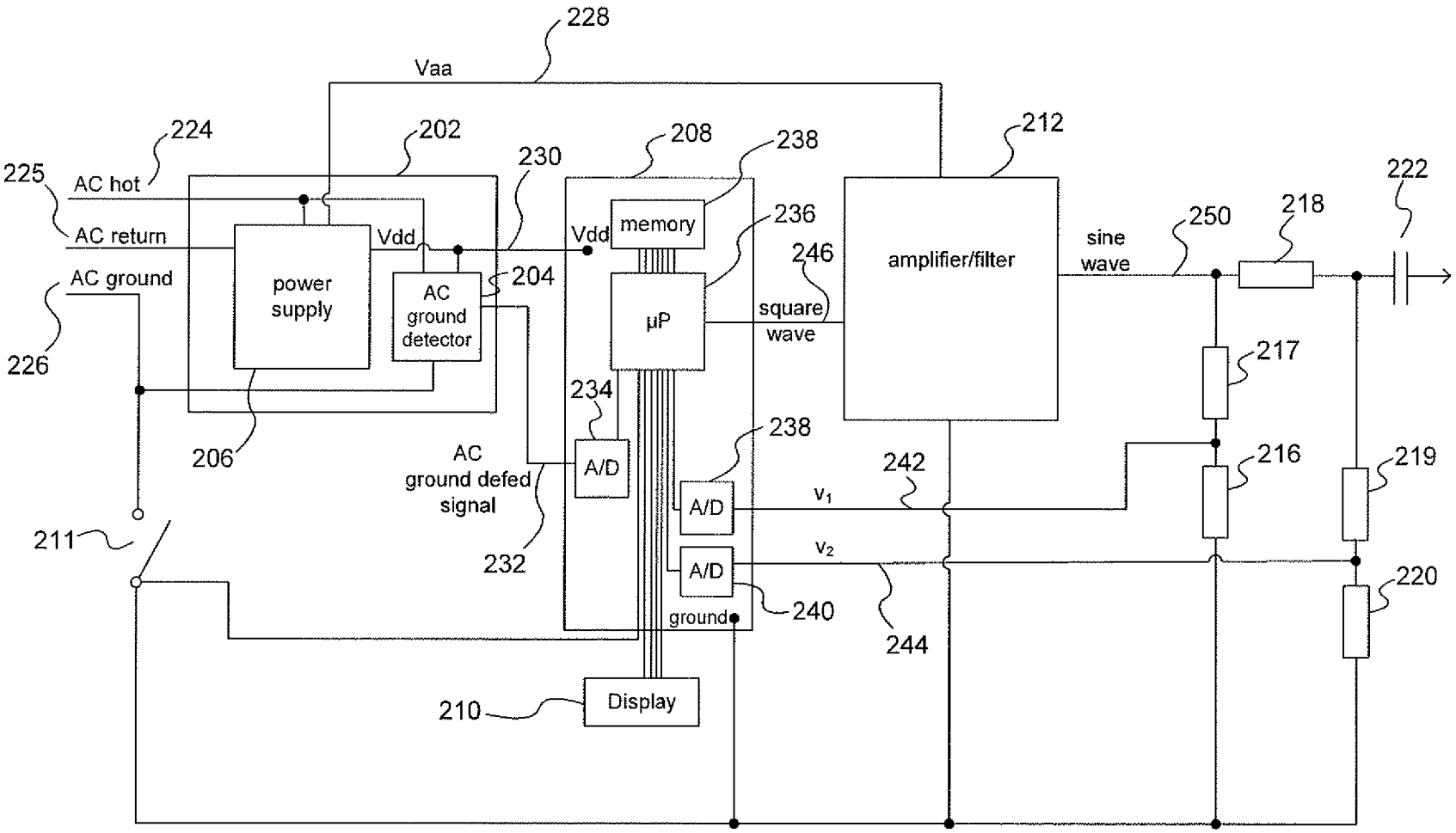
FIG. 2 provides a circuit diagram for the electronic components of the currently disclosed ground-detecting, direct-wire descalers.

FIG. 2 provides a circuit diagram for the electronic components of the currently disclosed ground-detecting, direct-wire descaler. The main electronic components include: a power-supply module 202; an AC-ground-detector circuit within the power-supply module or main unit 204; a power supply 206 within the power-supply module; a microprocessor module 208; the display 210, comprising the various lights discussed above with reference to FIG. 1, in one implementation, but having other forms and components in alternative implementations; a microprocessor-controlled relay 211; an amplifier/filter module 212; a power amplifier 214; a number of resistors 216-220; and a capacitor 222. Inputs to the electronic components include the three inputs provided by the power cord connected to a three-prong outlet, including AC hot 224, AC return 225, and AC ground 226. The power supply 206 produces a first output voltage 228 Vaa of +30V and a second output voltage 230 Vdd of +5 V in the illustrated implementation. Of course, these voltages may vary with implementation. The first output voltage is used to power the amplifier/filter module 212. The second output voltage is used to power components within the microprocessor module 208 and by the AC-ground-detector circuit 204.

The AC-ground-detector circuit 204 receives AC hot 224, AC ground 226, and the second output voltage Vdd 230 and outputs an AC-ground-detect signal 232. When there is no AC ground, the AC-ground-detector circuit outputs a constant signal of voltage Vdd. When AC ground is present, the AC-ground-detector circuit produces a time-varying signal that oscillates between digital ground and Vdd. The AC ground-detector signal is converted, by an analog-to-digital converter or digital input 234 within the microprocessor module 208, to a digital AC ground-detector signal input to the microprocessor 236. The microprocessor module 208 additionally contains a non-volatile memory 238 and two additional analog-to-digital converters 238 and 240 that convert analog signals V1 242 and V2 244 into digital signals input to the microprocessor 236. The microprocessor executes control logic, implemented as microprocessor instructions stored in the non-volatile memory 238, to control operation of the descaler and the descaler display based on the input signals 232, 242, and 244. The microprocessor also controls a microprocessor-controlled relay 211 to connect digital ground to AC ground, when the relay is closed, and to disconnect digital ground from AC ground, when the relay is open. AC ground is disconnected from digital ground during monitoring of the AC-ground-detect signal by the microprocessor. The microprocessor 236 produces a digital square wave output 246 that is input to the amplifier/filter module 212. The amplifier/filter module 212 outputs a nearly perfect oscillating sine-wave descaling signal 250. The voltage drop across resistor 218 is measured by the microprocessor using a first voltage signal V1 242 and a second voltage signal V2 244, the voltages of which are equivalently reduced by resistor pairs 217/216 and 219/220. From the measured voltage drop across resistor 218, the microprocessor can determine the output voltage and/or current of the output descaling signal 250. Finally, the capacitor 222 acts as a filter that passes the outgoing descaling signal but blocks incoming oscillating signals of lower frequencies and also blocks the DC component of the descaling signal.

Figure 3A:
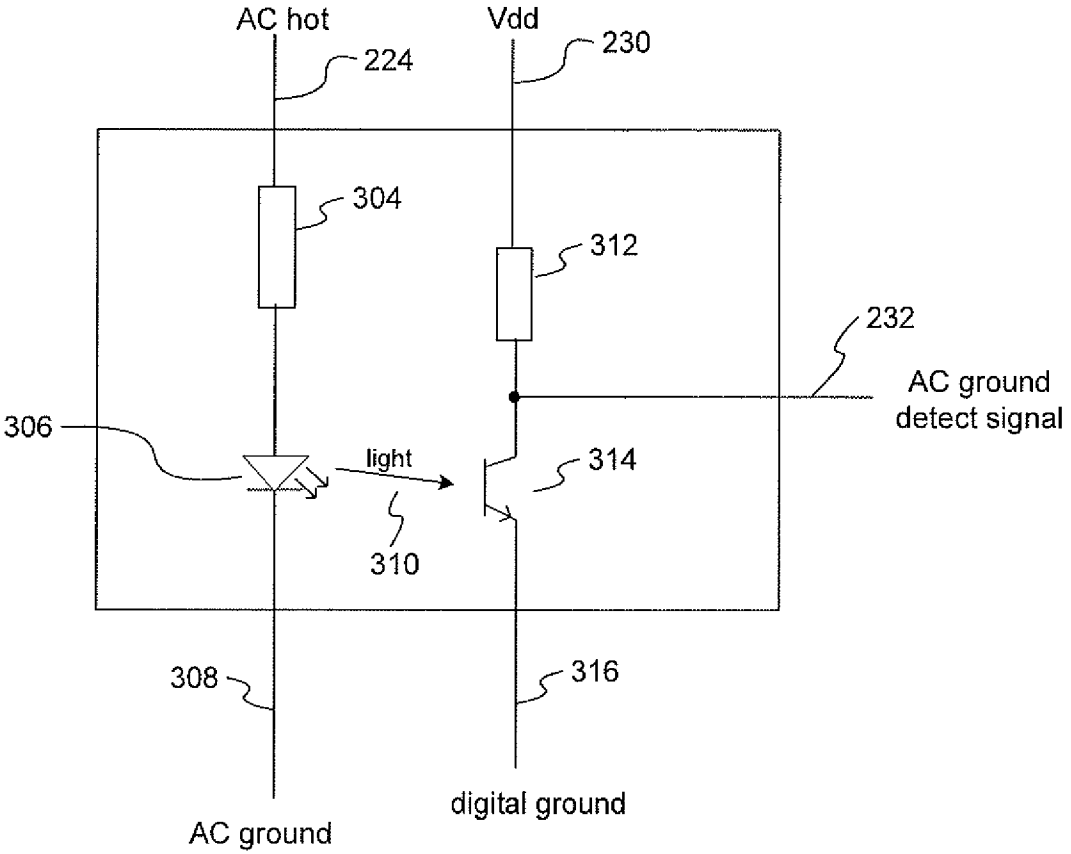
FIG. 3A illustrates the AC ground-detector circuit that is included within the power-supply module or in main descaler unit.

FIG. 3A illustrates the AC-ground-detector circuit (204 in FIG. 2) that is included within the power-supply module (202 in FIG. 2). As a manufacturing or production convenience, the AC-ground-detector circuit may be alternatively placed within the main descaler unit with additional wires leading from the power supply to provide the necessary inputs. AC hot 224 is input, through resistor 304 to a photodiode 306 that is, in turn, connected to AC ground 308. When AC ground is present, current is pulled through the resistor 304 and photodiode 306, causing the photodiode to produce light 310. Vdd 230 is input to the AC-ground-detector circuit through resistor 312 to a photosensitive transistor, or gate, 314 which is, in turn, connected to digital ground 316. When the gate is activated by light emitted from the photodiode 306, current is pulled through the resistor 312 and gate 314. Because the AC hot signal oscillates, light production by the photodiode also oscillates, producing an oscillating AC-ground-detect signal 232 that oscillates between Vdd and digital ground. However, when there is no AC ground, the photodiode 306 is not activated, and therefore the output AC-ground-detect signal remains at a constant voltage Vdd.

Figure 3B:
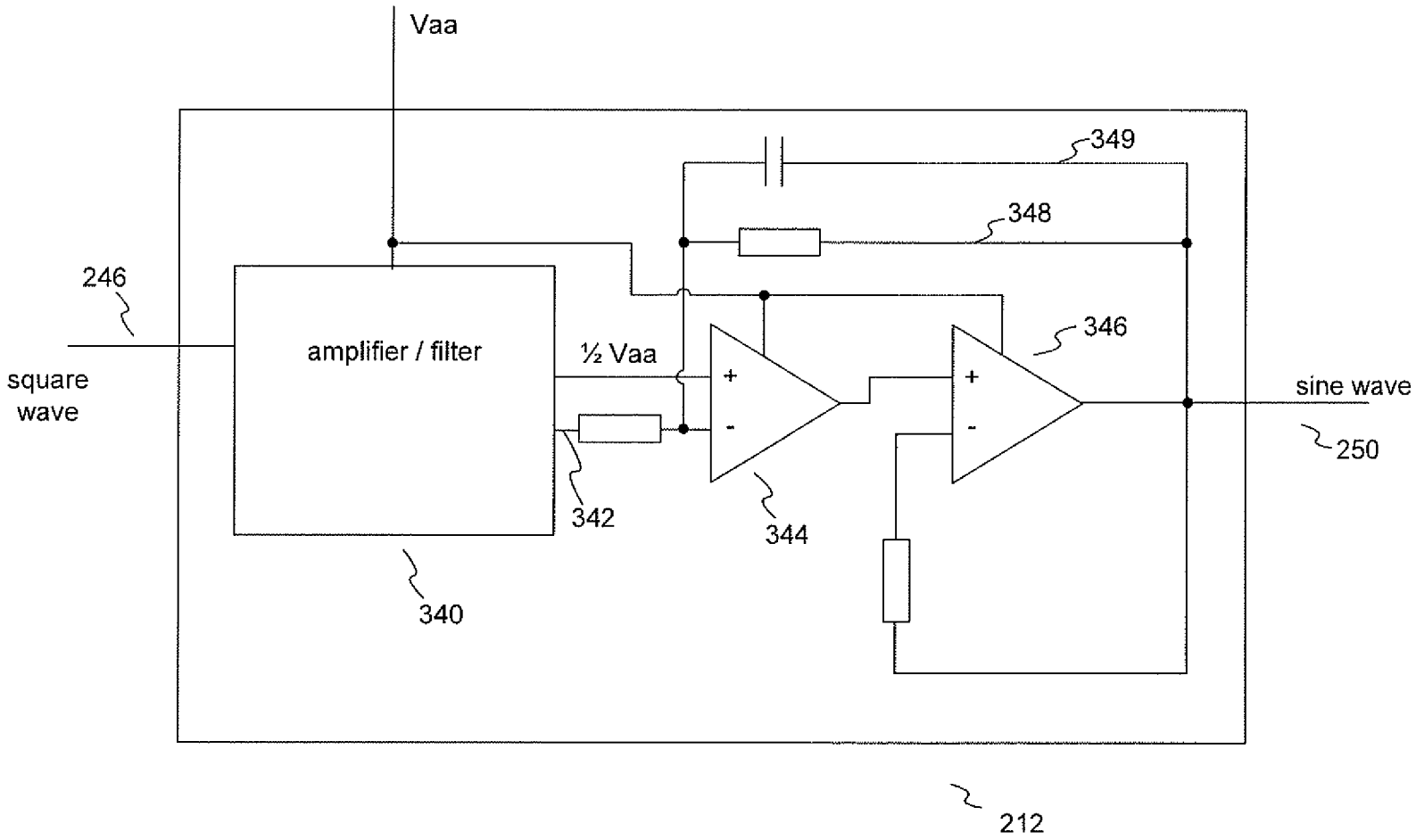
FIG. 3B illustrates additional details within the amplifier/filter module.

FIG. 3B illustrates additional details within the amplifier/filter module. The amplifier/filter module 212 includes an amplifier/filter unit 340 comprising a series of amplifiers and filers that produces a pure sine-wave 342, with almost no harmonic distortion, from the input square-wave signal 246. Amplifier 344 and power amplifier 346 together transmit the signal 346 as a nearly perfect oscillating sine-wave descaling signal 250 onto the pipe. By using feedback 348-349 from the output sine-wave descaling signal, amplifier 344 is able to compensate for inductance and capacitance of the pipe and thus amplifiers 344 and 346 are able to reproduce the almost distortionless sine-wave 246 at the pipe connection. By integrating the power amplifiers within the amplifier/filter module, the amplifier/filter module outputs a descaling signal to a pipe or other conductive equipment that is a near perfect sine wave, which allows the currently disclosed descaler to pass FCC requirements despite outputting a very high and very effective descaling-signal voltage. By contrast, currently available descalers input a descaling signal to a metal pipe without any feedback mechanism, resulting in distortion of the descaling signal by the inductance and capacitance of the pipe. The distorted signals have harmonics that fail FCC requirements. To ameliorate these problems, currently available decalers use lower-voltage descaling signals and/or reduce the duty cycle of the descaling signal to pass FCC requirements, both resulting in decreased descaling efficiencies.

Figure 4A:
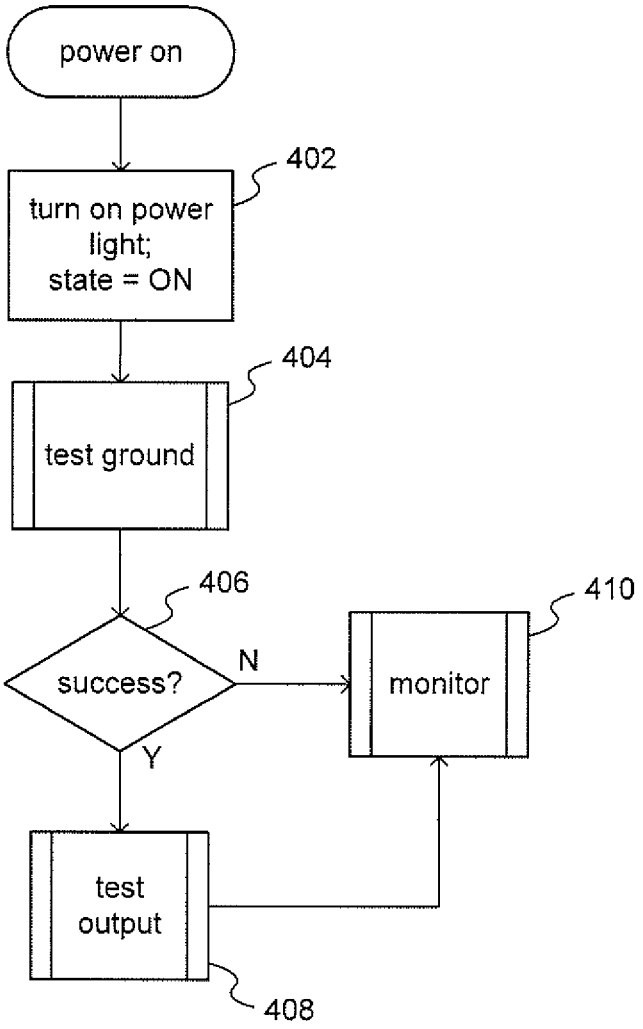
FIGS. 4A-D provide control-flow diagrams that illustrate the control logic implemented by a stored program executed by the microprocessor that controls operation of the descalers and the scaler display.

FIGS. 4A-D provide control-flow diagrams that illustrate the control logic implemented by a stored program executed by the microprocessor that controls operation of the descaler and the scaler display. FIG. 4A provides a control-flow diagram for a power-on routine that is automatically executed when the descaler is powered on. In step 402, the microprocessor turns on the power light (104 in FIG. 1) and sets a variable state to ON. The values that the variable state assumes are numerically ordered as follows: ON, AC_GROUND, SHORTED, OPERATING. In step 404, the power-on routine calls a test-ground routine to determine whether or not safety ground is present. When the test-ground routine returns an indication of SUCCESS, as determined in step 406, the power-on routine calls a test-output routine 408 to test whether a descaling signal of adequate strength is being produced. When the test-ground routine produces a FAILURE result, and following completion of the test-output routine, a monitor routine 410 is called to continuously monitor descaler operation. In certain implementation, in addition to testing for safety ground and AC-ground isolation of the pipe or other equipment to which the descaler is coupled, the control logic may, on power up, additionally test the voltage of the power supply to avoid problems associated with accidental use of an incorrect power supply.

Figure 4B:
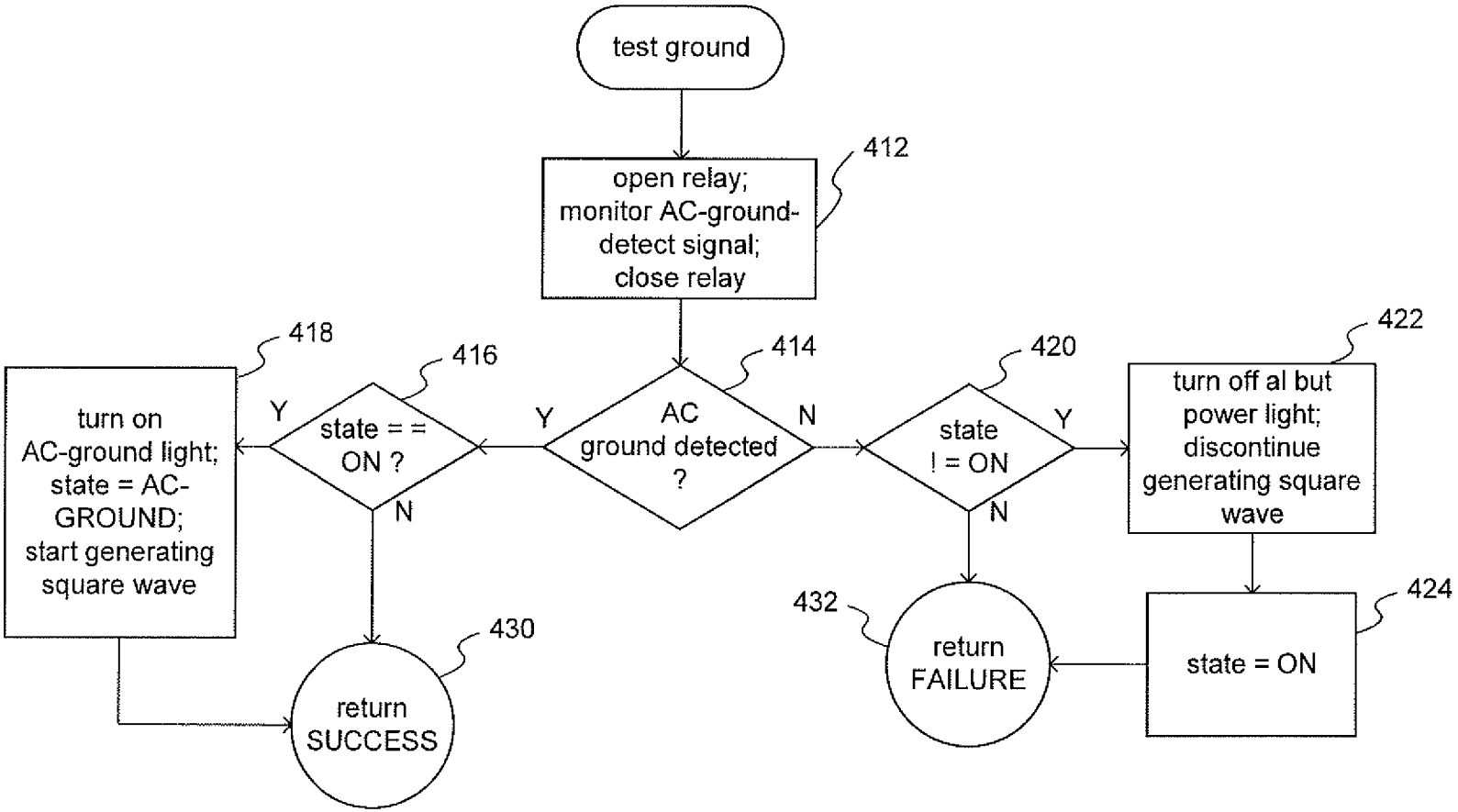

FIG. 4B provides a control-flow diagram for the test-ground routine called in step 404 of FIG. 4A. In step 412, the test-ground opens the relay (211 in FIG. 2), monitors the AC ground-detect signal, and closes the relay. When the AC ground-detect signal indicates that safety ground is present, as determined in step 414, then, when the current value of the variable state is ON, as determined in step 416, the microprocessor, in step 418, illuminates the AC-ground light (114 in FIG. 1), sets the variable state to AC_GROUND, an initiates square-wave generation. When no safety ground is detected, in step 414, then, when the current value of the variable state is not equal to ON, as determined in step 420, the microprocessor, in step 422, turns off all but the power light and discontinues square-wave generation and, in step 424, sets the variable state to ON. SUCCESS is returned by the test-ground routine, in step 430, when safety ground is detected and FAILURE is returned by the test-ground routine, in step 432, when safety ground is not detected.

Figure 4C:
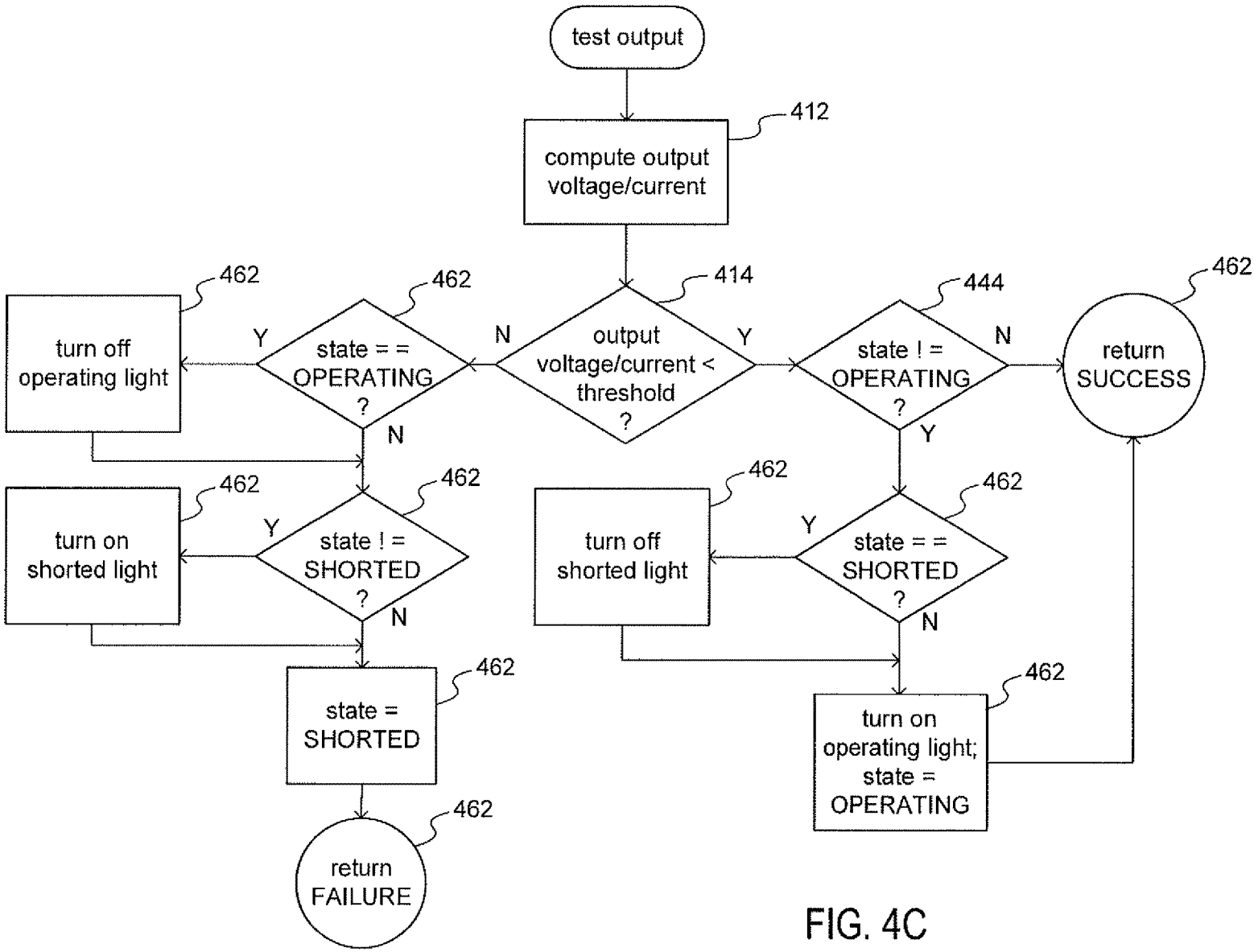

FIG. 4C provides a control-flow diagram for the test-output routine called in step 408 of FIG. 4A. In step 440, the microprocessor computes the output descaling-signal voltage or current from the signals V1 and V2. When the output voltage or output current is less than a threshold value, as determined in step 442, then, in step 444, the microprocessor determines whether the current value of the variable state is not equal to OPERATING. When the current value of the variable state is not equal to OPERATING, and when the current value of the variable state is SHORTED, as determined in step 446, the microbe processor turns off the shorted light (115 in FIG. 1), in step 448. When the current value of the variable state is not OPERATING, the microprocessor, in step 450, turns on the operating light (116 in FIG. 1). When the descaling-signal strength is greater than or equal to the threshold value, as determined in step 442, then, in step 452, the microprocessor determines whether the current value of the variable state is OPERATING. When the descaler is in the OPERATING state, the microprocessor, in step 454, turns off the operating light. When the descaler is not in the SHORTED state, as determined in step 456, the microprocessor, in step 458, turns on the SHORTED light. Finally, in step 460, the microprocessor sets the current state of the descaler to SHORTED. What an adequate descaling-signal is being produced, the test-output routine returns SUCCESS in step 462. Otherwise, the test-output routine returns FAILURE in step 464. An indication of the descaler signal level is displayed whether or not the shorted light is illuminated. This enables an installer to measure the signal level at several locations and determine what direction the installer needs to more the connection point to be farther away from AC ground in order to determine an optimal or near-optimal point for the connection.

Figure 4D:
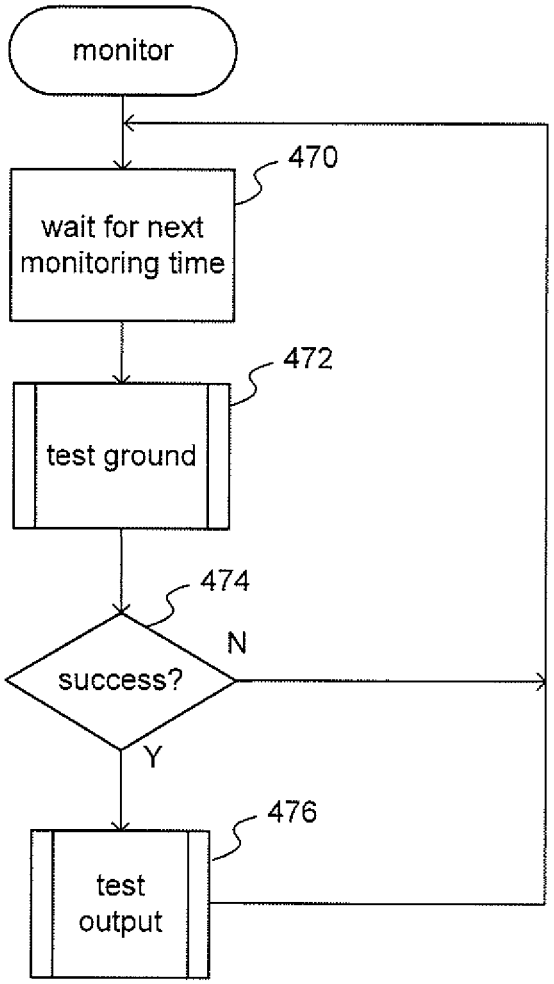

FIG. 4D provides a control-flow diagram for the monitor routine, called in step 410 of FIG. 4A. In step 470, the microprocessor waits for a next monitoring time. In step 472, the microprocessor calls the test-ground routine. When the test-ground routine fails to return SUCCESS, as determined in step 474, control flows back to step 470, where the microprocessor waits for a next monitoring time. Otherwise, in step 476, the microprocessor calls the test-output routine, after which control returns to step 470.

Using AC ground for signal ground presently requires additional FCC compliance. Magnetically coupled devices are required to pass FCC part 15*a* for industrial applications and FCC part 15*b* for home use. However, using AC ground for signal ground requires the descaler to also pass FCC part 18, which requires very careful design. The power supply both provides DC power to the internal circuits of the currently disclosed descaler and protects these circuits from the high voltage AC input. The AC ground detector connects to 90 to 250V AC to detect AC ground. The output of the ground detector is only a few volts DC so that the output does harm the microprocessor.

The AC-ground-detector circuit is included within the AC power supply, as shown in FIG. 2. The AC power supply outputs: (1) a 30V DC output to power the currently disclosed descaler; (2) a small-voltage DC power-supply output Vdd derived from the 30V DC output; and (3) an AC-ground-detect signal. The currently disclosed descaler circuit is connected to +30 DC volts and AC ground from the AC power supply. The output of the descaler circuit drives an output wire with a 125 to 142.8 khz sine wave with about 23V peak-to-peak signal. The currently disclosed descaler measures the output signal with an A-to-D and accompanying circuits. When the output circuit drives an external AC ground, the output signal level is pulled down toward AC ground. The closer the external ground is, the closer the output signal is pulled to AC ground.

The output load causes the power amplifier output to droop. This droop varies among different types of power amplifier. The circuit of FIG. 2 measures voltage drop across output resistor 218. The output current is calculated and the error due to power-amp droop is eliminated. The value Iout is equal to (V1−V2)/Rs. The distance to AC ground is inversely proportional to the value Iout. Note the current measured is of a 125 Khz to 142.8 Khz signal. The signal frequencies and amplitudes disclosed above represent those of the illustrated implementation. Other signal frequencies and amplitudes may be generated in alternative implementations.

Although the present invention has been described in terms of particular embodiments, it is not intended that the invention be limited to these embodiments. Modification within the spirit of the invention will be apparent to those skilled in the art. For example, as discussed above, many different types of displays may be alternatively employed by the currently disclosed the scaler, including liquid crystal displays or even output to cell-phone applications for display of information on cell phones. In certain embodiments, the descaler may output indications to the Internet for access from various computer systems. Additional implementations that use fewer, a greater number of, or different electronic components are possible. Similarly, by varying any of many different design and development parameters, including choice of microprocessor, assembler or compiler, control structures, modular organizations, a variety of alternative implementations of the control logic are possible. As discussed above, the currently described ground-detection futures may additionally be incorporated within a magnetically coupled to the scaler.

It is appreciated that the previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A ground-detecting, direct-wire electronic descaler comprising:

a housing;

a display positioned on or within the housing;

electronic components within the housing;

a power cord with a three-prong plug;

a direct-wire coupler that couples the electronic components to a water-containing conductive device;

a control program, executed by a microprocessor component of the electronic components, that controls the ground-detecting, direct-wire electronic descaler to initiate generation of an output to one or more of the electronic components for generation of an oscillating sine-wave descaling signal within the water contained in the water-containing conductive device, determine whether or not the water-containing conductive device is isolated from an AC ground, display an indication of whether or not the water-containing conductive device is isolated from the AC ground, determine whether or not the power cord is inserted into a three-prong outlet connected to a safety ground, and display an indication of whether or not the power cord is inserted within a three-prong outlet connected to the safety ground by monitoring an AC-ground-detect signal produced by an AC-ground-detector-circuit component of the electronic components.

2. The ground-detecting, direct-wire electronic descaler of claim 1 wherein the AC-ground-detector-circuit component includes a photodiode that produces a light signal when connected to AC ground and a photosensitive transistor connected to digital ground that, when illuminated by the light signal, produces the AC-ground-detect signal.

3. The ground-detecting, direct-wire electronic descaler of claim 1 wherein, when the AC-ground-detect signal is an oscillating voltage signal, the power cord is inserted within a three-prong outlet connected to safety ground, and when the AC-ground-detect signal is a constant voltage signal, the power cord is not inserted within a three-prong outlet connected to safety ground.

4. A ground-detecting, direct-wire electronic descaler comprising:

a housing;

a display positioned on or within the housing;

electronic components within the housing, including a power-supply module, an AC-ground-detector circuit that receives AC hot, AC ground, and a digital-power-supply voltage and outputs an AC-ground-detect signal, a power supply within the power-supply module, a microprocessor module, an amplifier/filter module, a power amplifier, a number of resistors, and a capacitor;

a power cord with a three-prong plug;

a direct-wire coupler that couples the electronic components to a water-containing metal pipe or other water-containing conductive equipment; and a control program, executed by a microprocessor component of the electronic components, that controls the ground-detecting, direct-wire electronic descaler to determine whether or not the power cord is inserted within a three-prong outlet connected to a safety ground, and when the power cord is inserted within a three-prong outlet connected to the safety ground, initiate generation of an output to one or more of the electronic components for generation of an oscillating sine-wave descaling signal within the water contained in the water-containing metal pipe or other water-containing conductive equipment, determine whether or not the water-containing metal pipe or other water-containing conductive equipment is isolated from an AC ground, and display an indication of whether or not the water-containing metal pipe or other water-containing conductive equipment is isolated from the AC ground, wherein the AC-ground-detect signal is the digital-power-supply voltage or a digital ground, when the power cord is inserted within a three-prong outlet that is not connected to the safety ground; and a time-varying signal that oscillates between the digital ground and the digital-power-supply voltage when the power cord is inserted within a three-prong outlet that is connected to the safety ground.

* * * * *